United States Patent [19]

Kunz

[11] 4,036,113

[45] July 19, 1977

[54] PRESSURE PISTON FOR A DIE-CASTING MACHINE

[76] Inventor: Hugo Kunz, Ziegeleistrasse 21, (D-7743) Frickenhausen, Germany

[21] Appl. No.: 616,993

[22] Filed: Sept. 26, 1975

[30] Foreign Application Priority Data

Sept. 28, 1974 Germany ..... 2446503
Oct. 8, 1974 Germany ..... 2447980

[51] Int. Cl.[2] ..... F01B 29/00; F01B 31/00; F16J 1/10

[52] U.S. Cl. ..... 92/111; 92/128; 92/258

[58] Field of Search ..... 92/110, 111, 255, 257, 92/258, 256, 259, 109, 157, 158, 172, 128, 112, 113; 403/259, 260, 261

[56] References Cited

U.S. PATENT DOCUMENTS 2,806,450 9/1957 Geyer ..... 92/110
2,955,574 10/1960 Geyer ..... 92/110
3,046,621 7/1962 Morton ..... 92/257
3,203,056 8/1965 Thompson et al. ..... 92/258

*Primary Examiner*—Paul E. Maslousky
*Attorney, Agent, or Firm*—Michael J. Striker

[57] ABSTRACT

The pressure piston for a die-casting machine comprises a carrier formed with a crown having a central blind bore closed at its driving end and with an abutment ring. Surrounding the carrier and abutting the abutment ring is a piston skirt forming with the carrier an annular space through which passes a cooling medium. The skirt is held in position by a threaded clamping sleeve engaging a thread on the carrier on the side of the annular space remote from the abutment ring. By providing a thread of suitable length the carrier can accommodate skirts of various sizes. For this reason the axial extent of the carrier part between the abutment ring and the securing region for the clamping sleeve is less than the maximum but greater than the minimum length of the piston skirts.

29 Claims, 6 Drawing Figures

PRESSURE PISTON FOR A DIE-CASTING MACHINE

BACKGROUND TO THE INVENTION

This invention relates to a pressure piston for a die-casting machine having a carrier passing axially through it, which carrier has a central blind bore, issuing from the piston side lying opposite to the piston end pressure surface and leading to the piston crown, for piston cooling, and having a detachable piston skirt the outer peripheral surface of which, at least over a part of its axial extent, forms a piston working surface, the piston skirt preferably being of a beryllium-copper alloy, the skirt being radially centered on the carrier and enclosing the latter with formation of an outwardly closed-off annular cooling medium space which, for piston cooling, is in communication through transverse passages serving for inflow and outflow with the blind bore. The arrangement is made so that the blind bore has in the piston crown a bore section of smaller diameter, into which there enters a cooling medium supply pipe contained in the piston rod carrying the piston, that the transverse passages are arranged on the opposite ends of the annular cooling medium space and the transverse passage allocated to the piston crown opens into the bore section, that the carrier itself forms the entire piston crown, which is formed as piston pressure surface and as radially protruding abutment ring, and that the carrier has a clamping sleeve screwable on to it and the piston skirt is firmly braced in the axial and radial directions with the carrier between abutment ring and clamping sleeve.

Such a pressure piston is relatively simple in construction and cheap in production, also it possesses very good sliding properties in relation to the piston skirt and renders long service lives possible. This is achieved inter alia by the tubular piston skirt, preferably of a beryllium-copper alloy, which can be replaced while the carrier can continue in use. This leads to extraordinarily good material exploitation.

OBJECT OF THE INVENTION

The invention is based upon the problem of improving this pressure piston to the effect that, with simple construction and possibility of cheap production, the service lives are increased still further by further improvement of the material exploitation.

SUMMARY OF THE INVENTION

In a pressure piston of the initially mentioned kind, the problem is solved according to the invention in that the axial extent of the carrier part between abutment ring and securing point for the clamping sleeve is less than the maximum length dimension but greater than the mininum length dimension of piston skirts which can be inserted between the abutment ring on the one hand and the clamping sleeve on the other hand which can be screwed on to the carrier in the region of the securing point. This achieves the object that piston skirts of different lengths can be secured on the carrier, in that for example a piston skirt seated on the carrier and associated by its length-diameter ratio to a cylindrical piston chamber appropriately adapted in dimensions thereto can be replaced by another piston skirt which possesses a different axial length and is allocated to another, appropriately dimensioned piston chamber. This exchange of piston skirts of different length the diameters of which can be different, is rendered possible without need for the carrier to be modified, for example machined, for this purpose. This leads to extraordinarily good material exploitation, and thus to an increase of the service life of the entire pressure piston. Since moreover a carrier with pre-determined dimensions can be used as standard part with standard dimensions for pistons of different dimensions at least as regards the axial length, the production and stockkeeping costs are also reduced. Although in the case of the configuration in accordance with the invention with a carrier of one single standard size for piston skirts of different lengths for replaceable securing on the carrier, an annular cooling medium space of constant volume is always provided, the cooling conditions, which likewise contribute to determining the achieved long service lives, are not disadvantageously influenced, for the cooling of the piston skirt is unvaryingly good in the end region adjacent the piston crown, that is where the greatest heat occurs. Rather, piston skirts of different lengths merely extend out with the end opposite to the end facing the piston crown more or less far according to length beyond the axial end of the annular cooling medium space given in this region. However this is the end of the piston skirt which is least stressed thermally and also mechanically.

In an advantageous form of embodiment the carrier comprises at the end opposite to its abutment ring an externally threaded extension provided with a passage bore aligned with the blind bore, and that the piston rod carrying the carrier with piston has for securing on the carrier, at its securing end, an internal thread matching the external thread of the threaded extension, by which the piston rod can be screwed on to the threaded extension. Thus as regards the connection between carrier and piston rod the object is achieved that an adaptation is possible to piston skirts of different lengths and thus, as regards the overall length, to pistons of different lengths. When the piston is secured to the piston rod, the end face of the piston rod lies against the facing end face of the clamping sleeve, which in turn lies against the facing end of the piston skirt. If the piston skirt has been replaced by a longer one, thus the entire piston has been lengthened. However since the piston and piston rod unit must always have the same length, for reasons concerning the machine, in these cases the piston rod must be shorter. In fact this could be achieved by replacing the over-long piston rod by a shorter one, but only with extraordinarily great expenditure of material and costs, since the piston rods are extraordinarily expensive. Now the connection in accordance with the invention permits of shortening the excessively long piston rod in the region of the securing end simply by cutting off a section of appropriate dimension, without the securing in the region of the connection between piston and piston rod then becoming mechanically weaker. Moreover an essential advantage consists in that existing piston rods, to which conventional pistons are secured, can be converted with simple means so that a pressure piston of the initially mentioned kind can be secured thereto, even if it is longer. Thus the existing piston rod can continue in use. It does not have to be replaced by a completely different one in order that the piston as described may be secured thereto. the adaptation of conventional piston rods having an externally threaded stepped piece at the securing end is effected simply in that the stepped piece and also, according to the required length, a further section are cut from the piston rod and a central, internally threaded bore is machined into the piston rod in the region of the securing end. This is simple and cheap. This adaptation of conventional piston rods to the pistons are described is thus possible with very little expense.

In a further advantageous form of embodiment it is provided that the threaded extension is screwed with a part of its externally threaded length into an internal thread matching the external thread and provided in the carrier, and thus is held detachably on the carrier. Thus in this case the threaded extension is a part independent of the carrier, for example with a continuous right-hand thread. In the case of pistons with very small external diameters on the other hand it can be advantageous if the threaded extension is fixedly arranged on the carrier, preferably in one piece therewith. Thus in the case of carriers of small diameter their cross-section remains unattenuated, which leads to high strengths even in the case of a very small piston diameter.

An especially advantageous form of embodiment consists in that the bore section of smaller diameter is formed by a tubular sleeve of a material of high thermal conductivity which is inserted into the blind bore at its end in the region of the piston crown, and in that the transverse passage allocated to the piston crown is in communication with the tubular passage of the tubular sleeve. The tubular sleeve can consist for example of aluminium. By this configuration the cooling effect is still further increased in the region of the piston crown, that is where the greatest heat occurs which is to be removed, whereby still longer service lives result, as the blind bore here terminates directly at the piston crown, so that in this region the bore section of smaller diameter is formed by the tubular sleeve of material of high thermal conductivity and better removal of heat is obtained there. Specifically at this point of high heating this leads to a noticeable improvement of the cooling and an increase of service life, which become very noticeable especially in the case of relatively thick pistons.

The transverse passage allocated to the piston crown can open into the bore section between the end of the blind bore and the end of the tubular sleeve facing the latter. This has the advantage that the quantity of material of the carrier is exactly as great in the region where the transverse passage opens into the bore section as on the other side of the tubular sleeve in the region of the blind bore. Since this small quantity of material is directly adjacent the piston crown and thus to the part subjected to the greatest thermal stress, the cooling and thus the service life are there still further increased.

Instead, the tubular sleeve can also comprise an auxiliary transverse passage which opens on the one hand into the tubular passage of the tubular sleeve and on the other into the transverse passage.

The tubular sleeve can be held detachably and replaceably in the blind bore. By way of example the tubular sleeve is screwed or pressed into the blind bore. The replaceability permits adaptation to cooling medium supply pipes of different diameters contained in the respective piston rod, which pipes lead in each case into the tubular sleeve. However the tubular sleeve can also be detachably secured to the end of the cooling medium pipe contained in the piston rod carrying the piston.

A pressure piston as initially described is made with the abutment ring and the clamping sleeve each having on the side facing the piston skirt an annular fitting and centering surface, with which there are associated corresponding fitting and centering surfaces provided on the associated ends of the piston skirt. In order to make these centering and fitting surfaces as simple as possible, in further development it is provided that the centering surfaces of the carrier are formed by the peripheral surfaces of cylindrical centering extensions provided on the carrier at the two ends, lying opposite to one another in the longitudinal direction of the carrier, of the annular cooling medium space, the diameter of which centering extensions corresponds to the internal diameter of the piston skirt and which close off the ends of the cooling medium annular space, and that the abutment ring and the clamping sleeve have end faces extending at right angles to the longitudinal central axis, on which faces the piston skirt abuts with its two corresponding end faces. This is simple and cheap in production and leads to a secure radial centering and axial bracing, also to a tight outward closure of the annular cooling medium space. The centering extensions can have an annular groove in which a sealing ring, preferably an O-ring, is arranged to seal the end of the annular cooling medium space. Thus the external sealing of the annular cooling medium space is still further improved with simple means.

The arrangement can further be made so that the abutment ring has a cylindrical annular step on its peripheral surface and that the piston skirt possesses, at least at the end associated with the abutment ring, an axially protruding annular collar the peripheral surface of which is aligned with that of the piston skirt and the cylindrical inner surface of which corresponds in diameter to the external diameter of the cylindrical annular step, in such a way that the annular collar of the piston skirt grasps over the annular step of the abutment ring at one end. It can further be provided that the cylindrical annular step of the abutment ring merges at its end facing the piston end pressure surface into the piston pressure surface, and that the axial extent of the annular step is equal to that of the annular collar of the piston skirt. This leads to great stability of the abutment ring in the edge region where the annular collar merges into the outer end pressure surface of the piston. Possible damage to the annular step in this region, for example danger of breaking away, is entirely precluded. Moreover a smooth, gapless or grooveless transition is achieved from the outer end piston pressure surface formed by the carrier to the free end face of the annular collar on the piston skirt. Thus the danger of any liquid material, in the die-casting cycle, remaining adhering to the piston in the region of the piston pressure surface is precluded.

In a further advantageous form of embodiment it is provided that the annular collar is arranged on both ends of the piston skirt that the external diameter of the clamping sleeve is just as great as the external diameter of the cylindrical annular step on the abutment ring and corresponds to the internal diameter of the annular collar, but is less than the external diameter of the piston skirt, and that the annular collar arranged on the end of the piston skirt remote from the abutment ring grasps over the outer surface of the clamping sleeve. Thus while the above-mentioned advantages are retained it is possible when the forward end part is worn to remove the piston skirt and secure it in the reversed position on the carrier again, so that then the rear end part of the piston skirt, which is subjected to less wear, is now seated forward.

The invention further relates to a device for retaining the pressure piston, with a piston rod to one end of which the pressure piston is detachably secured and which has at the opposite end a coupling piece with which the piston rod can be coupled coaxially with the facing end of a translationally movable drive ram.

For example in the usual way the coupling piece has a radially protruding annular collar and, at the end facing the drive ram, an end face extending at right angles to the longitudinal central axis of the piston rod, so that the piston rod is couplable through the coupling piece with the facing end of the drive ram by means of a cap nut grasping over the annular collar and screwable on to the drive ram, in such a way that the end face of the coupling piece comes to abut on that of the drive ram.

As is known, in the die-casting or injection-molding process, for the production of injection moldings, into a cylindrical filler bush acting as piston chamber, in which the piston is reciprocatingly movable through the drive ram coupled with the piston rod as component of a translationally working drive system, for example a hydraulic piston-cylinder unit, before the commencement of the injection-molding cycle, in front of the piston pressure surface liquid material, for example metal or a metal alloy, is introduced which then is compressed to high pressure and forced into a closed injection mold consisting of two mold halves and in communication with the filler bush, by sudden shot-type forward springing of the piston in the filler bush. Here the piston rod serves at the same time for the supply and withdrawal of cooling medium, for example liquid, into and from the pressure piston, for piston cooling. For this purpose the piston rod as a rule consists of a tube having an internal, smaller, cooling medium supply pipe, which terminates at a short distance from the crown of the pressure piston on its side remote from the piston pressure surface. The cooling medium is introduced under pressure into the cooling medium supply pipe, passes through it, issues from it at a distance before the piston crown, flows through the pressure piston and flows back through the annular space formed between cooling medium supply pipe and bore in the piston rod, and away again through an outlet in the piston rod.

In known manner the pressure piston is detachably secured at the one end of the piston rod to this rod in that the piston rod possesses a threaded stepped piece which can be screwed into a threaded bore of the pressure piston. The diameter of the pressure piston is greater than that of the piston rod. The essential point is that in the known devices of the stated kind the coupling piece at the one end of the piston rod is an integral component of the latter.

On account of heavy and rapid wear of the pressure piston this must relatively frequently be replaced by a new one. Irrespective of this, when the injection-molding machine mould is changed, the pressure piston must also be replaced by a new pressure piston adapted to the mold. The piston rod itself is relatively durable and at least does not need renewal so frequently. However experience shows that about fifteen piston rods are worn out per die-casting machine per year, so that replacement of the piston rod is also necessary at specific, but longer, time intervals.

The replacement of a pressure piston takes place as follows: The die-casting machine is halted. Then the two mold halves are opened and the mold half most remote from the pressure piston is removed. Then the piston rod is uncoupled from the drive ram by unscrewing of the cap nut, the cap nut remaining on the piston rod. Then the piston rod is pushed forward with the pressure piston secured to its, the pressure piston being pushed wholly through the filler bush, until it protrudes completely on the far side of the outer surface, forming the mold surface, of the mold half still remaining in the machine, and is accessible from this side. Then the pressure piston is unscrewed from this side and replaced by a new one, which is screwed on to the end of the piston rod. All this takes place with the filler bush, mold half and pressure piston still hot. In order to reach the initial position again with the new pressure piston now secured, then the same operations are carried out in the converse sequence. If in this exchange of the pressure piston, or independently thereof, it is desired to take the piston rod out of the die-casting machine, for example to replace it by a new one or one with different length dimensions, then the piston rod can be removed from the machine only if the pressure piston is unscrewed, for only after then can the piston rod be withdrawn through the filler bush and then taken out from the length between filler bush and end of the drive ram, as a result of the reduction of its axial length by the axial length of the pressure piston. Then the cap nut can be removed and pushed on to a new piston rod, which is then installed in the converse manner.

This conversion on account of replacement of the pressure piston and/or piston rod is extraordinarily expensive. It requires effort and is costly on account of the relatively long machinery standstill times and wage costs. Moreover for the operator who carries out the replacement there is a high degree of danger of injury, since it is necessary to work in the region of the still hot filler bush and one mold half. Furthermore there is the danger of damage in these manipulations to the very delicate and expensive filler bush and the mold half. The same applies to the pressure piston, if it is to be used again and can be so used, which thus is the case when only the piston rod is replaced or when the pressure piston is replaced by one with different dimensions on account of change of mold, or equally when the worn pressure piston is to be restored by turning of the peripheral surface of the piston. In addition, in this known device the material used for the piston rod with integral coupling piece is very great, which is why the piston rod is also relatively costly, for the piston rod possesses a great axial length and a correspondingly long axial bore for the piston cooling which is extraordinarily expensive to produce on account of the fact that it is produced by deep hole boring. On account of the annular collar on the coupling piece of the piston rod the material loss in its production is considerable; for in the production of the piston rod one starts from rod stock which is to be machined by cutting to a diameter considerably smaller than the diameter of the annular collar over the length between the annular collar and the end where the pressure piston is to be secured.

Therefore in accordance with the invention a device is to be produced for the retention of a pressure piston for die-casting machines which renders possible a simpler, quicker and cheaper replacement of the pressure piston and/or of the piston rod, so that the conversion times are substantially reduced, and which at the same time leads to a simpler and cheaper piston rod.

To solve this problem, in a device of the stated kind the arrangement is made so that the coupling piece and the piston rod are detachably connected with one another in the direction transverse to the longitudinal central axis of the piston rod and that between piston rod and coupling piece an axial distance piece or spacer is arranged for taking out transversely of the longitudinal central axis of the piston rod. Thus in this case the coupling piece on the one hand and the piston rod on the other are two independent parts, of which the coupling piece or spacer can remain secured to the drive ram when the piston rod and/or the pressure piston are replaced. For replacement, firstly the axial distance piece is taken out in the direction transverse to the longitudinal central axis of the piston rod. Then there is an axial clearance for the piston rod with the axial dimension which this axial distance piece has. Therefore — with the drive ram fully retracted — the piston rod can be displaced in the axial direction by the above-mentioned axial amount in the direction towards and relative to the drive ram. This axial amount corresponds to the axial dimension of the axial distance piece and is made at least as great as the axial distance by which, with the drive ram fully retracted, the pressure piston protrudes with its forward end into the filler bush. Thus if the piston rod is shifted by the axial amount in the direction towards and relative to the drive rams, the pressure piston is entirely extracted from the filler bush and is then no longer guided at all in the axial direction, so that at this end there is free mobility transverse to the longitudinal central axis of the piston rod. Then the piston rod, at its end facing the coupling piece, can be detached from the coupling piece in the direction transverse to the longitudinal central axis of the piston rod and then taken out in the above-mentioned direction together with the pressure piston secured to the piston rod. Thus replacement of the pressure piston can take place outside the machine, without danger of injury or hot machine parts or of damage to machine part, especially filler bush, mold half and pressure piston. Moreover for this replacement all parts are easily accessible, so that work in strained positions is eliminated. Above all, replacement can take place quickly, reliably and cheaply. Thus fitting times are substantially reduced, which leads to substantially shorter machine standstill times and better exploitation of the machines. Furthermore the piston rod is shorter than in the known device, thus cheaper as regards utilised material, which likewise has a cost-saving effect in view of the necessary replacement of the piston rod on account of damage and wear. Moreover the service life of the piston rod is increased, since as a result of the shorter length it is not subjected to such heavy stresses, especially bending and buckling stresses. Since the coupling piece remains fixed on the drive ram, the securing of the coupling piece can also be made simpler than with annular collar and cap nut. By way of example the coupling piece, for securing, can have at the end an internal thread with which it is screwed on to an associated external thread on the end of the drive ram.

In one advantageous form of embodiment it is provided that the coupling piece has at the end pointing towards the end of the piston rod a fixedly arranged cylinder half shell into which the associated end of the piston rod can be embedded, that the piston rod has at this end a radially protruding annular step and the cylinder half shell has at its free end a radially inwardly projecting shoulder grasping behind the annular step, and that a securing device is provided which secures in the radial direction the piston rod embedded in the fixedly arranged cylinder half shell. This arrangement is simple and cheap by design. The piston rod is laid with its end into the cylinder half shell, which is arranged fixedly, preferably in one piece, on the coupling piece, which is and remains held firmly on the drive ram for example with the cap nut grasping over its annular collar, or by means of screw threads. The piston rod is coupled with the drive ram in the direction of traction thereof by means of the shoulder which grasps behind the annular step of the piston rod. Coupling in the thrust direction takes place through the axial distance piece extractably arranged between the end of the piston rod and the coupling piece. The securing device, as radial securing device, holds the unit together in the radial direction, while the axial distance piece can advantageously likewise be securable in the radial direction by means of the securing device.

According to a further advantageous form of embodiment it is provided that the axial distance piece is arranged in the cylinder half shell in the axial interspace between the free end face of the piston rod and a radial bottom face facing this and provided at the end opposite to the free end of the cylinder half shell and extends in the axial direction over the whole length of the interspace. This axial dimension of the axial distance piece is at least as great as the amount by which the pressure piston projects with its free end into the filler bush when the drive ram with piston rod is entirely retracted.

In advantageous further development the arrangement can be that the coupling piece has a removable cylinder half shell which is made in conformity with the fixedly arranged cylinder half shell, encloses the piston rod end on its half circumference extending outside the fixedly arranged cylinder half shell, is connectable with the fixedly arranged cylinder half shell to form a closed sleeve and is securable by means of the securing device. Thus the object is achieved that the piston rod, in the inserted condition, is entirely enclosed at the end by the two cylinder half shells. It can further be advantageous if the axial distance piece consists of a cylinder piece the external diameter of which is approximately as great as the internal diameter of the sleeve formed from the cylinder half shells. In advantageous further development the axial distance piece is secured to the removable cylinder half shell. Then to release the piston rod from the coupling piece the removable cylinder half shell, and with it the axial distance piece secured thereto, are lifted away in the radial direction, whereby the axial interspace for the axial movement in relation to the coupling piece is produced for the piston rod.

It can further be advantageous if the cylinder half shells possess equal axial lengths and the axial distance piece is secured to the inner wall of the removable cylinder half shell at its end lying opposite to the shoulder.

According to a further advantageous form of embodiment it is provided that the securing device comprises a ring which can be slid in the axial direction over the two cylinder half shells and holds them closed.

This securing device can furthermore be provided with arrangements to secure against rotation and axial shifting, in order to preclude self-loosening in operation. Thus according to a further advantageous form of embodiment it is provided that the fixedly arranged and/or the removable cylinder half shell has on its peripheral surface an axially extending guide groove open towards the free end of the cylinder half shell and that the ring has a radially inwardly protruding guide peg which, when the ring is pushed on to the closed cylinder half shells, runs into the guide groove in the direction towards the free ends of the shells to secure against rotation. In this way, security against rotation is given with simple means. It can further be advantageous if the fixedly arranged and/or removable cylinder half shell has a peripheral groove on its peripheral surface and if the ring carries at least one threaded pin which can be screwed into the peripheral groove as axial security against shifting, when the ring is pushed on.

BRIEF DESCRIPTION OF THE DRAWINGS

The invention is explained hereinafter in greater detail by reference to examples of embodiment which are shown in the drawings, wherein.

DESCRIPTION OF PREFERRED EMBODIMENT

Figure 1:
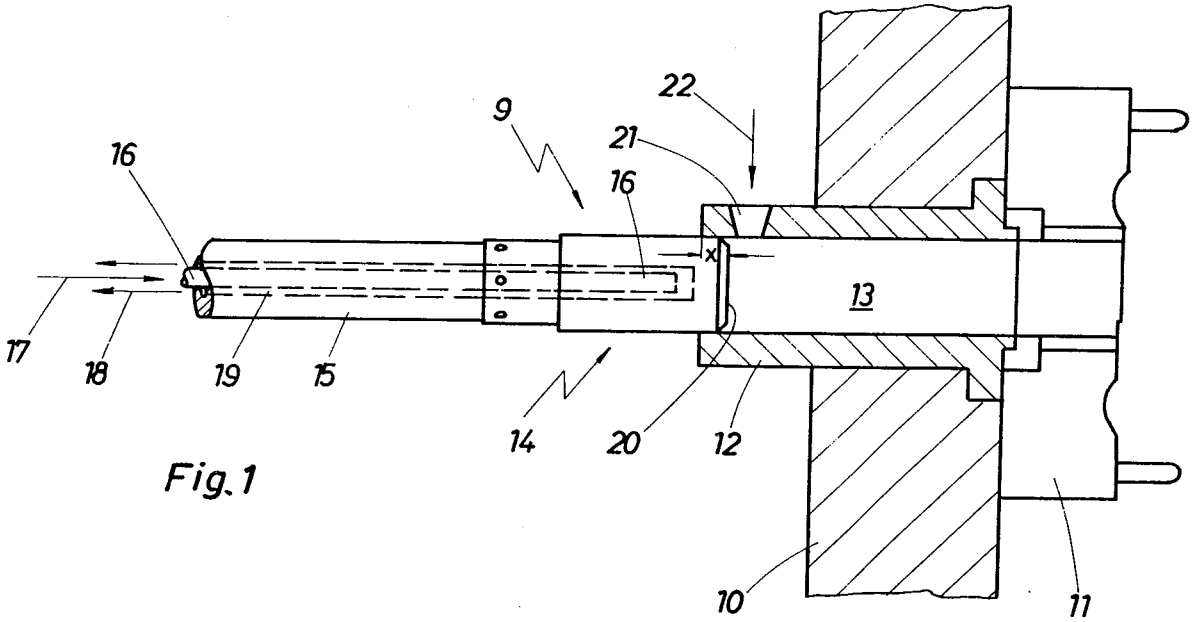
FIG. 1 shows a diagrammatic, partially sectional, lateral view of a part of an injection-molding machine.

The injection-moulding machine 9 as partially illustrated in FIG. 1 comprises a rigid housing part 10, to which one mold half 11 is secured. The other mold half associated with the mold half 11 is held on a movable part (not shown) of the machine, which is shifted in the direction towards the housing part 10 to close the mold before the injection-molding cycle. In the housing part 10 there is secured a cylindrical filler bush 12 which forms a cylindrical piston chamber 13 which is in communication with the mold cavity of the two mold halves. A pressure piston or plunger designated in general by 14 is displaceable to and fro in the piston chamber 13 by means of the drive ram 8 indicated in dashed lines in FIG. 2, which is a component of a cylinder-piston unit, for example a hydraulic unit. As will be explained subsequently with reference to FIGS. 2 and 3, the drive ram 8 is secured by means of a special device to the end of a piston rod 15 remote from the pressure piston 14, which rod carries the pressure piston 14 at one end. The piston rod 15 consists of a tube in which there is contained an inner cooling medium supply pipe 16 of smaller diameter, through which a cooling medium, for example water, is introduced in the direction of the arrow 17 into the interior of the pressure piston 14. The cooling medium supply pipe 16 passes through an axial bore 19 in the piston rod 15, with radial spacing. The return flow of the cooling medium takes place through the annular space formed between the axial bore 19 in the piston rod 15 and the outer peripheral surface of the cooling medium supply pipe 16, in the direction of the arrows 18.

No details are shown of the supply to the cooling medium supply pipe 16 and the withdrawal from the annular space in the piston rod 15. The axial bore 19 is tightly closed by a plug in the region of the piston rod end lying opposite to the pressure piston. The supply to the cooling medium supply pipe 16 takes place through a radial bore in the piston rod 15 and a connection piece seated on the piston rod 15. The withdrawal from the axial bore 19 is of the same configuration.

In the wall of the filler bush 12 at that point which lies before the piston end pressure surface 20 when the pressure piston 14 is retracted there is provided a feeding opening 21 which opens into the pressure chamber 13, through which liquid material, for example metal or a metal alloy, is introduced from the exterior in the direction of the arrow 22 into the piston chamber 13 before the beginning of the injection-molding cycle and shot-type advance of the pressure piston 14.

Figure 3:
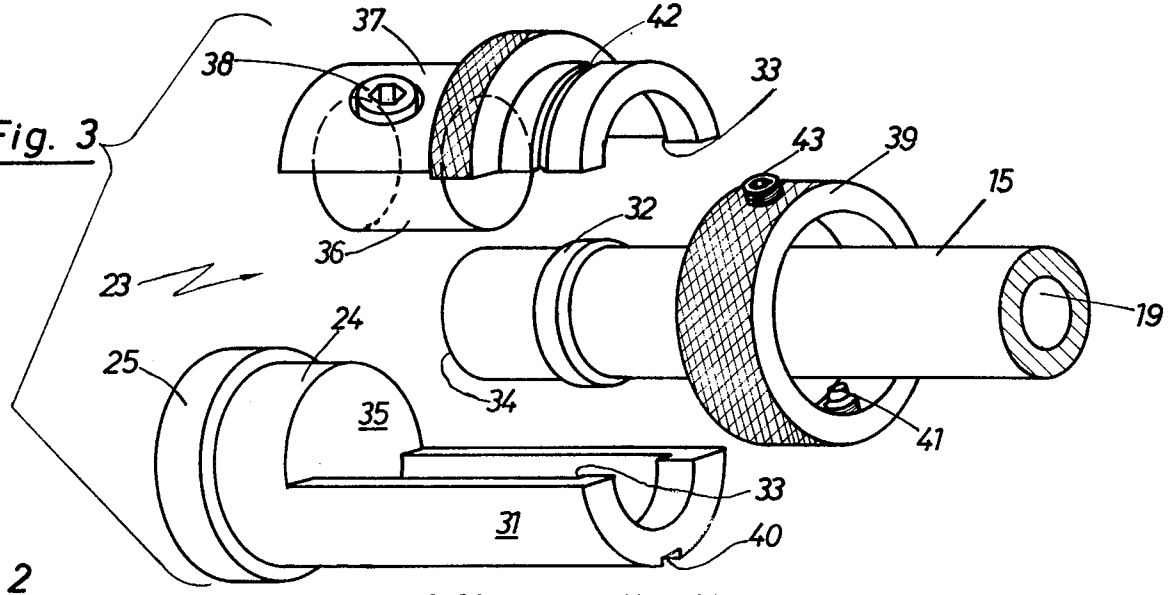
FIG. 3 shows an exploded perspective representation of the individual parts for the securing of the piston rod.

A device designated in general by 23 will now be explained with reference to FIGS. 2 and 3, by means of which device the piston rod 15 is coupled by its end opposite to the pressure piston 14 with the facing end of the drive ram 8 of the translational drive system of the machine. The device 23 comprises a substantially cylindrical coupling piece 24 having on the end to the left in FIGS. 2 and 3 a radially protruding annular collar 25 which terminates at the end remote from the piston rod in an end face 27 extending at right angles to the longitudinal central axis 26 of the piston rod 15. The coupling piece 24 lies substantially flat with its end face 27 against the facing end face 28 of the drive ram 8 and is secured to the drive ram 8 by means of a cap nut 29 grasping over the annular collar 25 and screwed on to a threaded stepped portion 30 on the end of the drive ram 8. The coupling piece 24 thus secured to the drive ram 8 is a component of the drive ram 8 and is not released again once secured thereto. The coupling piece 24 is a part independent of the piston rod 15 and upon which the piston rod 15 is detachably held in the direction transverse to its longitudinal central axis.

At the end facing away from the end face 27 the coupling piece 24 has a cylinder half shell 31 firmly connected with it, for example in one piece, in which the associated end of the piston rod 15 can be seated. The piston rod 15 carries at this end a radially protruding annular step 32, with which on the free end of the interior of the cylinder half shell 31 there is associated a radially inwardly protruding annular shoulder 33 grasping behind the annular step 32, against which shoulder the piston rod 15 rests in the axial direction with its annular step 32. An extractable axial distance piece 36 formed as a cylindrical body is inserted into the axial interspace between the free end face 34 of the piston rod 15 and a radial bottom face 35 facing the latter and provided on the end opposite to the free end of the cylinder half shell 31. The axial length of the axial distance piece 36 is made at least as great as the axial dimension $x$ (see FIG. 1) by which the pressure piston 14 projects with its forward end into the filler bush 12 when the drive ram 8 is fully retracted.

The coupling piece 24 further comprises a removable cylindrical half shell 37 which is formed in conformity with the fixedly arranged cylinder half shell 31, that is likewise possesses the annular shoulder 33 and the same axial length. It can be seen from FIG. 2 that the lower cylinder half shell 31 in this illustration encloses the lower half circumference of the end of the piston rod 15. In a corresponding manner the removable cylinder half shell 37 uppermost in FIG. 2 encloses the upper half circumference of the end of the piston rod 15. The two cylinder half shells 31 and 37 can be assembled to form a closed sleeve in which the end of the piston rod is held. The external diameter of the cylindrical axial distance piece 36 is substantially, but at maximum, as large as the internal diameter of the sleeve formed from the two cylinder half shells 31 and 37. The axial distance piece 36 is secured for example by means of screws 38 to the inner wall of the removable cylinder half shell 37 at the end lying opposite to the annular shoulder 33, so that when the upper cylinder half shell 37 is lifted away the axial distance piece 36 is drawn out at the same time with it in the radial direction.

With the coupling piece 24 there is also associated a securing device in the form of a ring 39 by means of which the piston rod 15 embedded in the lower cylinder half shell 31 is secured in the radial direction in this position, while at the same time the axial distance piece 36 is also secured against falling out in the radial direction. The ring 39 is to be pushed over the two cylinder half shells 31 and 37, lying one upon the other, axially in the direction towards their free end, and then holds the two cylinder half shells 31, 37 closed in the radial direction.

The cylinder half shell 31 connected firmly with the coupling piece 24 has on its circumferential surface an axially extending guide groove 40 opened towards the free end of the cylinder half shell 31. In a corresponding manner the ring 39 possesses a radially inwardly protruding guide peg 41 which enters the guide groove 40, to secure against rotation, on pushing of the ring 39 on to the closed cylinder half shells 31, 37 in the direction towards their free ends. Thus the guide groove 40 and the guide peg 41 provide a security of the ring 39 against rotation. The removable cylinder half shell 37 has a peripheral groove 42 on its outer peripheral surface. The ring 39 carries at least one threaded pin 43 which can be screwed into the peripheral groove 42 as axial security against shifting, when the ring is pushed on.

Figure 2:
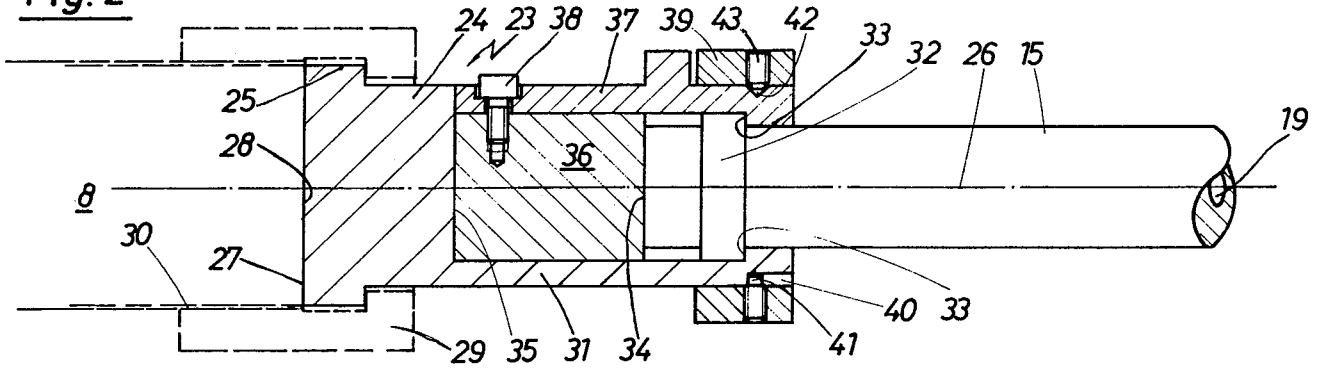
FIG. 2 shows an enlarged axial longitudinal section of the securing of the piston rod on the machine.

In the operation of the injection-moulding machine the piston rod 15 is coupled with the drive ram 8, as shown by FIG. 2, with the end shown in FIG. 2 which lies opposite to the end carrying the pressure piston 14. If now the pressure piston 14 is to be replaced by another pressure piston, then the threaded pin 43 which forms the axial securing for the ring 39 is unscrewed until it comes out of engagement with the peripheral groove 42. Then the ring 39 can be withdrawn in the axial direction, toward the pressure piston 14, from the two cylinder half shells 31 and 37 forming a sleeve, so that the upper cylinder half shell 37 in FIGS. 2 and 3 becomes free and can be withdrawn radially upwardly together with the axial distance piece 36 secured to it. Thus an axial interspace is produced over the length between the bottom face 35 and the opposite end face 34 of the piston rod 15. The axial dimension of this free interspace corresponds substantially to the axial length of the axial distance piece 36 and is at least as large as, as a rule even larger than, the axial dimension shown as $x$ in FIG. 1, with which the pressure piston 14 protrudes with its forward end into the filler bush 12 when the drive ram 8 is approximately fully retracted. The piston rod 15 can now be displaced, together with the pressure piston 14 secured to its end, in the axial direction towards the bottom face 35 of the coupling piece 24 and in relation to the latter the pressure piston 14 being drawn with its free end entirely out of the filler bush 12 and thus becoming free. Since the piston rod 15 is no longer upwardly gripped at the end facing the coupling piece 24, as a result of the removal of the cylinder half shell 37, the piston rod 15 together with the pressure piston 14 can be taken out upwardly in a direction transverse to the longitudinal central axis 26 in the arrangement according to FIGS. 2 and 3. Then the pressure piston 14 can be unscrewed from the piston rod 15 and a new pressure piston can be secured, outside the machine and without need to work in the vicinity of hot machine parts. Likewise, in place of or simultaneously with the replacement of the pressure piston 14, the piston rod 15 can be replaced by another. After exchange of the pressure piston and/or the piston rod has taken place the piston rod is introduced into the machine again in the direction transverse to its longitudinal central axis 26, namely in a manner in which the end of the piston rod facing the drive ram 8 is inserted from above into the lower cylinder half shell 31. Then the piston rod 15 is advanced in the axial direction towards the filler bush 12 until the pressure piston engages with its forward end in the piston chamber 13 and thus in guided there. Then the piston rod 15 is advanced still further until it strikes with its annular step 32 on the annular shoulder 33 of the cylinder half shell 31. Then the removed upper cylinder half shell 37 is placed from above upon the lower cylinder half shell 31, while at the same time the axial distance piece 36 engages in the interspace formed between the bottom face 35 and the end face 34 of the piston rod 15. Next the ring 39 is pushed on to the two cylinder half shells 31 and 37, the guide peg 41 running into the guide groove 40 and striking upon its axial end, whereby it is indicated that the ring 39 is pushed on far enough in the axial direction and the threaded pin 43 is situated above the peripheral groove 42 on the upper cylinder half shell 37. Then for the axial securing of the ring 39 the threaded pin 43 is screwed in radially until it engages in the peripheral groove 42. The guide peg 41 engaging in the guide groove 40 here forms a security against rotation for the ring 39. The exchange is then concluded. In all operations the coupling piece 24 remains firmly connected through the cap nut 29 with the drive ram 8, that is to say it is not loosened and dismantled.

Thus the replacement of the pressure piston 14 and/or of the piston rod 15 can take place quickly, reliably and cheaply. The fitting times for the machine are therefore extraordinarily short. The release of the pressure piston 14 from the piston rod 15 and the securing of another pressure piston can take place outside the machine, without danger of injury on hot machine parts and damage to machine parts, especially the filler bush 12 and mold half 11. The pressure piston too is not damaged. Moreover for this exchange all parts are easily accessible, so that work in strained positions is eliminated. It is also advantageous that the piston rod 15 is shorter than in known devices, and thus cheaper as regards material used, which likewise has a cost-saving effect in view of the replacement of the piston rod 15 necessary from time to time on account of damage and wear. The shorter length of the piston rod 15 also results in a shorter length of the axial bore 19, which is extraordinarily expensive in production by deep hole boring, so that on account of the shorter length of the piston rod 15 the costs for this are also reduced. Moreover the service life of the piston rod 15 is increased, as the latter, becuase of its shorter length, is not subjected to such great stresses, especially bending and buckling stresses. Moreover the piston rod 15 is cheaper, because substantially less material and less cutting work are necessary for its production, for in conventional piston rods the piston rod 15 is an intergral part of the coupling part 24 which however possesses the same dimensions in the region of the coupling piece as are indicated in FIG. 2. In the production of such a piston rod one starts from rod material having an initial diameter at least corresponding to that of the annular collar 25. This rod material is then turned down, over the length between the annular collar 25 and the end to which the pressure piston is secured, to a diameter dimension considerably smaller than the annular collar 25, which is extraordinary expensive on account of the utilisation and loss of material and also on account of the lathing operation. On the other hand the piston rod 15 according to the invention requires substantially less material and cutting work and also leads to only slight material-removing cutting losses, on account of the relatively small diameter of the annular step 32.

In one example of embodiment (not shown) the coupling piece 24 is screwed on to or into the facing end of the drive ram 8. In this case the annular collar 25 and the cap nut 29 are eliminated. In place of them the coupling 24 has an internal threading at the end by which it is screwed on to the threaded stepped piece 30 of the drive ram 8. Instead the coupling piece 24 can also have an externally threaded stepped piece which engages in an internal threading of the end of the drive ram 8.

Figure 4:
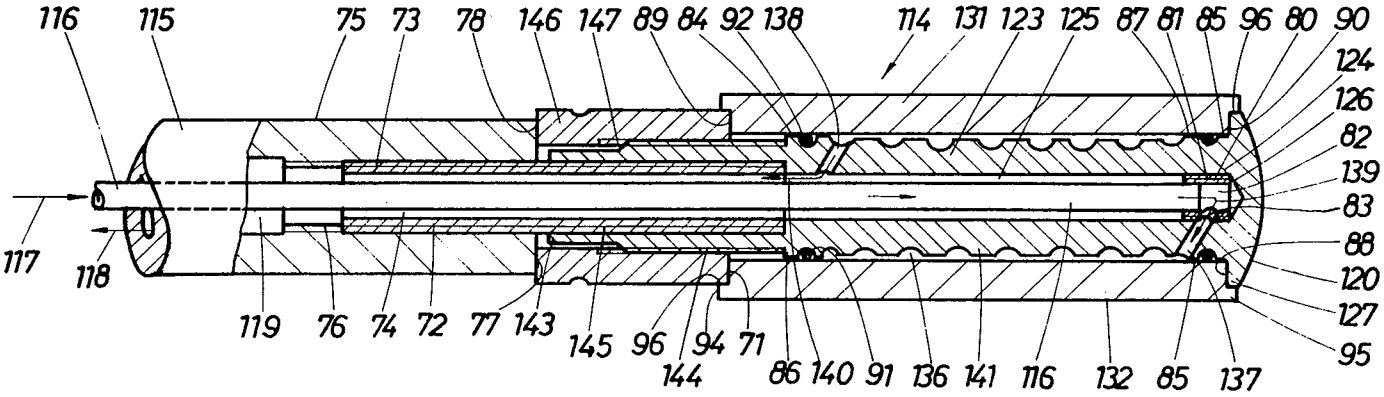
FIG. 4 shows a lateral view, with partial axial longitudinal section, of a pressure piston according to one example of embodiment, with a part of the piston rod carrying it.
Figure 5:
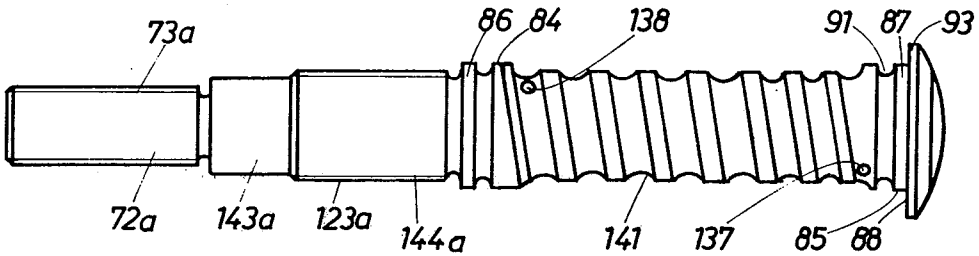
FIG. 5 shows a lateral view of the piston part formed as carrier, according to a second example of embodiment.

The special configuration of the pressure piston itself is explained below with reference to FIGS. 4 to 6. FIG. 4 shows a first example of embodiment of a pressure piston 114. The pressure piston 114 is secured to a piston rod 115 which consists of an external tube containing an internal cooling medium supply pipe 116 of smaller diameter, through which a cooling medium, for example water, is introduced in the direction of the arrow 117 into the interior of the piston 114. The return flow of the cooling medium takes place by way of the annular space 119 formed between the cooling medium supply pipe 116 and the inner peripheral surface of the bore provided in the piston rod 115. The return flow of the cooling medium is indicated by the arrow 118.

The piston 114 has a carrier 123 of very stable and rigid formation, for example of steel, which has a central blind bore 125 issuing from the side opposite to the piston end pressure surface 120 and leading to the piston crown 124, for piston cooling, which bore has at the end adjacent the piston crown 124 a bore section 126 with smaller diameter, which corresponds substantially to the diameter of the cooling medium supply pipe 116 of the piston rod 115, which pipe, when the piston 114 is in the condition secured to the piston rod, leads through the blind bore 125 and into the bore section 126 and then terminates shortly before the piston crown 124.

The carrier 123 has at the end adjacent the piston crown 124 a radially projecting stop ring 127 which forms the piston pressure surface 120.

On the carrier 123 a piston skirt 131, for example of a beryllium-copper alloy, is detachably held, which is clamped in the axial direction on the carrier 123 and centred in the radial direction and the outer peripheral surface 132 of which, at least over a part of its length, forms the piston working surface with which the piston 114 can slide in a piston chamber (not shown).

Between the cylindrical inner peripheral surface of the piston skirt 131 and the outer surface of the part of the carrier 123 enclosed in this region by the piston skirt 131 there is formed an outwardly closed cooling medium annular space 136 extending in the axial direction, into which there protrudes a cooling medium guide fin of rib form 141 extending helically on the carrier 123. This fin can equally be omitted. At each of the two axial ends of the annular cooling medium space 136 the carrier 123 has a transverse bore 137, 138, through which the annular cooling medium space 136 communicates with the blind bore 125. The transverse bore 137 adjacent the piston crown 124 serves for the inflow of the cooling medium in the direction of the arrow 139 from the pipe 116 into the annular cooling medium space 136 and the opposite transverse bore 138 serves for the outflow of the cooling medium in the direction of the arrow 140 from the annular cooling medium space 136 into the annular space 119.

At the end opposite to the stop ring 127 the carrier 123 possesses an extension 143 having an external thread 144 and an internal thread 145, both formed as right-hand threads. A clamping sleeve 146 having an internal thread 147 matching the external thread 144 is screwable with its internal thread 147 on to the extension 143 and the external thread 144, so that the piston skirt 131 can be axially clamped and radially centered on the carrier 123 between the stop ring 127 of the carrier 123 and the facing end face 71 of the clamping sleeve 146.

It appears from FIG. 4 that the axial length of the part of the carrier 123 which extends between the stop ring 127 and the securing point for the clamping sleeve 146 is less than the maximum length dimension but greater than the minimum length dimension of a piston skirt 131 bittable to the carrier 123 therebetween. This means that the piston skirt 131 protrudes with its end remote from the piston pressure surface 120 over the end of the annular cooling medium space 136 provided in this region in the direction towards the extension 143 of the carrier 123. In the region of the extension 143 a threaded extension 72 with an external thread 73 is secured on the carrier 123 and screwed with a part of its length into the internal thread 145 of the carrier 123. The external thread 73 is made as right-hand thread and extends for example over the whole axial length of the threaded extension 72. The threaded extension 72 is provided with a passage bore 74 which is aligned with the blind bore 125. The piston rod 115 carrying the carrier 123 with the piston 114 has at its securing end 75, for securing to the carrier 123, an internal thread 76 of relatively great depth matching the external thread 73 of the threaded extension 72, whereby the piston rod 115 is screwed so far and so firmly on the threaded extension 72 that the end face 77 of the securing end 75 abuts the facing end face 78 of the clamping sleeve 146. Thus the securing extension 72 is detachably held on the carrier 123. This arrangement is especially expedient in the case of pistons of relatively large diameter. In the case of pistons of very small diameter the internal thread 145 provided in the extension 143 of the carrier 123 would lead to an excessive reduction of cross-section. In this case, according to the second example of embodiment shown in FIG. 5, the threaded extension 72*a* is arranged fixedly on and integrally with the carrier 123*a*, in that the threaded extension 72*a* integrally joins the extension 143*a* which carries the external threading 144*a*. Otherwise the carrier as shown in FIG. 5 according to the second example of embodiment is identical with the first example of embodiment as shown in FIG. 4.

In both examples of embodiment, as indicated in FIG. 4, the bore section 126 of smaller diameter is formed by a tubular sleeve 80 for example of aluminum, that is a material with high thermal conductivity. The tubular sleeve 80 is inserted, in the region of the piston crown 124 at the end of the blind bore 125, into the latter, detachably and replaceably, for example by being screwed in with threading 81 or pressed in. In the interior of the tubular sleeve 80 a tubular passage 82 is formed the internal diameter of which substantially corresponds to the external diameter of the cooling medium supply pipe 116 and which communicates with the forward transverse passage 137 allocated to the piston crown 124. This communication is provided by the fact that the tubular sleeve 80 has an auxiliary transverse passage 83 which opens on the one hand into the tubular passage 82 and on the other into the transverse passage 137.

Figure 6:
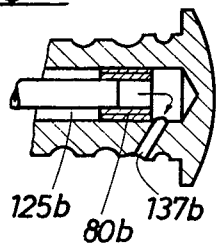
FIG. 6 shows a lateral view with partial axial longitudinal section of the forward part of the carrier, according to a third example of embodiment.

The third example of embodiment as shown in FIG. 6 differs from the first in FIG. 4 only in regard to the arrangement of the tubular sleeve 80*b*. In the third example of embodiment this sleeve is inserted into the blind bore 125*b* in such a way that between the bottom of the blind bore and the facing end of the tubular sleeve 80*b* an interspace remains into which the forward transverse passage 137*b* opens so that it is in communication with the blind bore 125*b* between the bottom of the bore and the tubular sleeve 80*b*. As regards all other parts the carrier according to the third example of embodiment is in conformity with that according to FIG. 4 or 5.

As may be seen from FIG. 4, the stop ring 127 and the clamping sleeve 146 have fitting and centering faces on the side facing the piston skirt 131 in each case, with which faces there are associated corresponding faces provided on the associated ends of the piston skirt 131.

The centering faces of the carrier 123 are formed by the cylindrical peripheral surfaces 84, 85 of cylinder centering extensions 86 and 87 respectively provided on the carrier 123 at the two ends of the annular cooling medium space 136 lying opposite to one another in the longitudinal direction of the carrier 123. The diameter of the centering extensions 86 and 87 corresponds to the internal diameter of the piston skirt 131. Moreover the centering extensions 86, 87 close off the ends of the annular cooling medium space 136. According to FIG. 4 the stop ring 127 and the clamping sleeve 146 have end faces 88 and 71 respectively extending at right angles to the longitudinal central axis, against which faces the piston skirt 131 abuts with its two corresponding end faces 90 and 89 respectively. The centering extensions 86 and 87 each have an annular groove 91 in which an O-ring 92 is arranged to seal off the ends of the annular cooling medium space 136.

The stop ring 127 further has on its peripheral surface a cylindrical annular step 93. At each of the two ends the piston skirt 131 has an axially protruding annular collar 94, 95, the peripheral surface of which is aligned with that surface 132 of the piston skirt 131 and the cylindrical inner surface 96 of which corresponds in diameter to the external diameter of the cylindrical annular step 93, in such a way that the annular collar 95 provided on the one end of the piston skirt 131 grasps over the annular step 93 of the top ring 127. Here the cylindrical annular step 93 of the stop ring 127, at its end facing the piston end pressure surface 120, merges substantially gaplessly into the piston pressure surface 120, this being achieved in that the axial lengths of the annular step 93 is equal to that of the annular collar 95 of the piston skirt 131. Thus at the forward piston end a smoothly continuous, gapless end face is formed on which no liquid material can adhere in the return stroke of the piston.

The external diameter of the clamping sleeve 146 is made just as large as the external diameter of the cylindrical annular step 93 of the stop ring 127, the two above-mentioned external diameters corresponding to the internal diameter 96 of the annular collar 94, 95 of the piston skirt 131, but being smaller than the external diameter of the piston skirt 131. The annular collar 94 arranged on the end of the piston skirt 131 remote from the stop ring 127 therefore grasps with the cylindrical inner surface 96 over the outer surface of the clamping sleeve 146. In this way it is possible to replace the piston skirt 131 on the carrier 123 in such a way that the forward end of the piston skirt 131 in FIG. 4 then lies to the rear and the rear end forward.

I claim:

1. A plunger for a die-casting machine, said plunger comprising:
   - a carrier having and elongated along a longitudinal axis, said carrier being formed at one axial end with a piston crown and at said crown with a radially projecting flange and with a blind bore extending to immediately adjacent said crown and opening at the other axial end of said carrier, said carrier further having centered on said axis and extending axially away from said crown a carrier portion formed with an external thread;
   - a clamping ring threaded onto said thread at said carrier portion; and
   - a detachable piston skirt formed as an axially elongated sleeve having a central portion radially spacedly surrounding said carrier and braced axially between said flange and said ring, said carrier portion extending axially away from said crown past said ring.

2. The plunger defined in claim 1 wherein said blind bore is formed at said crown with a region of reduced cross-sectional size and with a first radially throughgoing passage at said region and another radially throughgoing passage spaced axially from said first passage but axially within said skirt, said plunger further comprising a pipe extending axially along said bore spaced radially from said skirt between said passages and having an end received snugly in said region.

3. The plunger defined in claim 2 wherein said carrier portion is formed by a first portion of predetermined diameter and threadedly carrying said clamping ring and a second portion of substantially smaller diameter extending axially away from said crown from said first portion.

4. The plunger defined in claim 3 wherein said first and second portions are integral.

5. The plunger defined in claim 3 wherein said carrier has an elongated threaded tube threaded into said carrier and constituting said second portion.

6. The plunger defined in claim 3 wherein said skirt is made of a copper alloy and said carrier is made of steel.

7. A pressure piston for a die-casting machine, said piston comprising:
   - a piston rod;
   - a cooling medium supply pipe contained in said piston rod;
   - an axially elongated carrier having one axial end forming a piston crown constituting a piston end pressure surface and formed with an abutment ring, said carrier being formed for piston cooling with a central blind bore opening axially at the other axial end of said carrier and terminating adjacent said piston crown, said carrier being further formed with transverse passages extending from said bore at axially spaced locations, said bore having at said one axial end a bore section of a reduced bore diameter receiving said supply pipe, said carrier having between its said axial ends a threaded portion;

a detachable piston skirt having an external surface forming over at least part of its axial extent a piston working surface, said skirt forming with said carrier an annular cooling medium space closed off to the to the exterior and communicating with said bore through said transverse passages and for inflow and outflow of a cooling medium, said skirt having one axial end bearing axially on said abutment ring formed at said crown; and a clamping sleeve threaded onto said carrier at said threaded portion and bearing axially on the other axial end of said skirt, whereby said skirt is firmly clamped axially between said sleeve and said abutment ring.

8. The pressure piston defined in claim 7, further comprising an externally threaded extension mounted on the carrier at its said other axial end and formed with a passage bore axially aligned with said blind bore, said piston rod being provided with an internal thread matching the external thread of said extension and threaded thereinto.

9. The pressure piston defined in claim 8, wherein said carrier has an internal thread threaded onto said external thread of said extension.

10. The pressure piston defined in claim 7 wherein said carrier is provided at said bore section of reduced bore diameter with a lining sleeve of a metal of high thermal conductivity.

11. The pressure piston defined in claim 10 wherein one of said transverse passages opens into said bore at said lining sleeve.

12. The pressure piston defined in claim 11 wherein ssaid lining sleeve is formed with an auxiliary transverse passage aligned radially and communicating with said one transverse passage.

13. The pressure piston defined in claim 10 wherein said lining sleeve is removably mounted in said blind bore.

14. The pressure piston defined in claim 10 wherein said lining sleeve is removably mounted on said supply pipe.

15. The pressure piston defined in claim 7 wherein said skirt has a pair of oppositely directed axial end faces lying in respective planes perpendicular to said axis, said abutment ring having an annular face lying in a plane perpendicular to said axis and directed away from said piston crown, said clamping sleeve having an annular face lying in a plane perpendicular to said axis and directed toward said piston crown, one of said end faces of said skirt bearing sealingly on said face of said abutment ring and the other of said end faces of said skirt bearing axially sealingly on said face of said clamping sleeve, said carrier further being formed at each of the axial ends of said skirt with a centering surface and said skirt being formed with corresponding centering surfaces snugly and radially sealingly engaged therewith.

16. The pressure piston defined in claim 15 wherein said carrier is formed at its said centering surfaces with grooves and is provided in said grooves with O-rings engaging said centering surfaces of said skirt.

17. The pressure piston defined in claim 15 wherein said skirt is formed on its axial end face bearing on said ring with a step fitting with and partially around said ring.

18. The pressure piston defined in claim 17 wherein said step has a radial dimension equal to the radial projection of said ring from said carrier.

19. The pressure piston defined in claim 17 wherein said skirt is formed on its axial end face bearing on said sleeve with another such step fitting with and partially around said sleeve.

20. The pressure piston defined in claim 7, further comprising:

a coupling piece securable between said piston rod at the axial end thereof opposite said carrier and separable in a direction transverse to an axis of said rod, said coupling piece being adapted to be mounted on an actuating ram for said piston; and an axial distance piece positioned on said axis between said rod and said coupling piece.

21. The pressure piston defined in claim 20 wherein said coupling piece has an end region toward said piston rod provided with a laterally removable half cylinder shell, said piston rod being formed in said coupling piece with an outwardly projecting ridge, said coupling piece and said shell together forming an inwardly projecting ridge axially engaging said ridge of said rod.

22. The pressure piston defined in claim 21, further comprising means for securing said axial distance piece in said shell.

23. The pressure piston defined in claim 21, wherein said coupling piece is complementarily shaped to said shell to form therewith a cylindrical sleeve, said piston further comprising means for securing said coupling piece and said shell radially together.

24. The pressure piston defined in claim 21 wherein said axial distance piece is generally cylindrical and has an outside diameter corresponding to the inside diameter of said shell.

25. The pressure piston defined in claim 21 wherein said distance piece is fixed in said shell.

26. The pressure piston defined in claim 21 wherein said half shell is a removable half shell and said coupling piece is formed with an identical half shell constituting a fixed half shell of the same axial length as said removable half shell.

27. The pressure piston defined in claim 26, further comprising a ring engageable around said half shells.

28. The pressure piston defined in claim 27 wherein said ring is provided with an inwardly projecting pin and said fixed half shell is formed with an axially extending groove, said pin being receivable in said groove.

29. The pressure piston defined in claim 27 wherein said fixed half shell is formed with a circumferential groove, said ring being provided with an inwardly screwable screw engageable in said groove.

* * * * *